United States Patent [19]

Maton

[11] Patent Number: 4,846,150

[45] Date of Patent: Jul. 11, 1989

[54] VERTICAL TUBE WATER HEATER

[75] Inventor: Maurice E. G. Maton, Romsey, England

[73] Assignee: Beaumont (U.K.) Limited, Romsey, England

[21] Appl. No.: 84,999

[22] Filed: Aug. 13, 1987

[30] Foreign Application Priority Data

Aug. 21, 1986 [GB] United Kingdom ..... 8620377

[51] Int. Cl.[4] ..... F24H 1/00

[52] U.S. Cl. ..... 126/362; 126/350 R; 122/182 S

[58] Field of Search ..... 126/361, 362, 365, 250 R; 122/182 S, 17, 44 A, DIG. 1, DIG. 3

[56] References Cited

U.S. PATENT DOCUMENTS

| | | | |
|---|---|---|---|
| 1,356,098 | 10/1920 | Trumble | 122/182 S |
| 2,787,256 | 4/1957 | Illwe | 126/182 S |
| 4,157,078 | 6/1979 | Ostbo | 122/182 S |
| 4,170,963 | 10/1979 | Siegrist | 122/182 S X |
| 4,271,789 | 6/1981 | Black | 126/361 X |
| 4,465,025 | 8/1984 | Schroder | 126/361 X |
| 4,531,509 | 7/1985 | Wilhelm, Jr. | 126/362 |
| 4,543,943 | 10/1985 | Gruber et al. | 126/350 R |

*Primary Examiner*—Randall L. Green

*Attorney, Agent, or Firm*—Renner, Otto, Boissele & Sklar

[57] ABSTRACT

A vertical tube water heater comprising a water tank within which are located a plurality of tubes and a vertical combustion tube provided at its upper end with a burner, the bottom ends of said tubes and combustion tube being in communication with a chamber located at the bottom of the tank and the upper ends of the tubes being in communication with a header chamber located at the upper end of the tank and which is in communication with an exhaust duct, the arrangement being such that when the water heater is operating at low temperature settings any condensation formed within the tubes is evaporated or drained and can not reach the burner to extinguish it or its pilot light.

12 Claims, 4 Drawing Sheets

VERTICAL TUBE WATER HEATER

BACKGROUND OF THE INVENTION

This invention relates to a vertical tube water heater.

A vertical tube water heater is known from GB-A-2 145 803 which comprises a water tank, a plurality of vertical tubes located within the tank, one end of each of the tubes being in communication with a combustion chamber located at the bottom of the tank and in which are provided burners, and the other end of each tube is in communication with a chamber located at the upper end of the tank and which is in communication with an exhaust duct. When such a known water heater is operated at low temperature settings, condensation is produced in the vertical tubes and the condensate falls by gravity into the combustion chamber and can extinguish the pilot light of the burner or even the burner itself. Therefore such vertical tube water heaters can not be operated at low temperature settings.

SUMMARY OF THE INVENTION

This invention as previously stated relates to a vertical tube water heater.

An object of the invention is to provide a water heater which can operate at low temperature settings and in which any condensation produced in the vertical tubes will not adversely affect operation of the water heater.

According to the present invention there is provided a vertical tube water heater comprising a water tank, a plurality of vertical tubes located within the tank, one end of each of the tubes being in communication with a first chamber located at the bottom of the tank for receiving hot gases from a burner and the other end of each of said tubes being in communication with a second chamber located at the upper end of the tank, the second chamber being in communication with an exhaust duct, and located within the tank is a vertical combustion tube which at its upper end is provided with the burner and at its bottom end is in communication with said first chamber. The water heater is further characterized by the second chamber being in communication with the exhaust duct via a third chamber located beneath the first chamber, and the exhaust duct being provided with a fan for drawing air through the water heater to the burner and for drawing exhaust gases from the second and third chambers. As further described below, an annular air duct surrounds the tank for conveying combustion air from beneath the bottom of the tank to an air chamber located above the tank and which air chamber is in communication with the burner. The annular duct and the annular air duct are each provided with vanes, which extend within the respective duct; and the burner is located within a perforated tube connected to the upper end of the burner tube and extending through the air chamber.

BRIEF DESCRIPTION OF THE DRAWINGS

To the accomplishment of the foregoing and related ends, the invention then comprises the features fully hereinafter described and particularly pointed out in the claims, the following description and annexed drawings setting forth in detail illustrative embodiments of the invention, there being indicative however of only two ways in which the principles of the invention may be employed.

In said annexed drawings.

DESCRIPTION OF THE PREFERRED EMBODIMENTS

Figure 1:
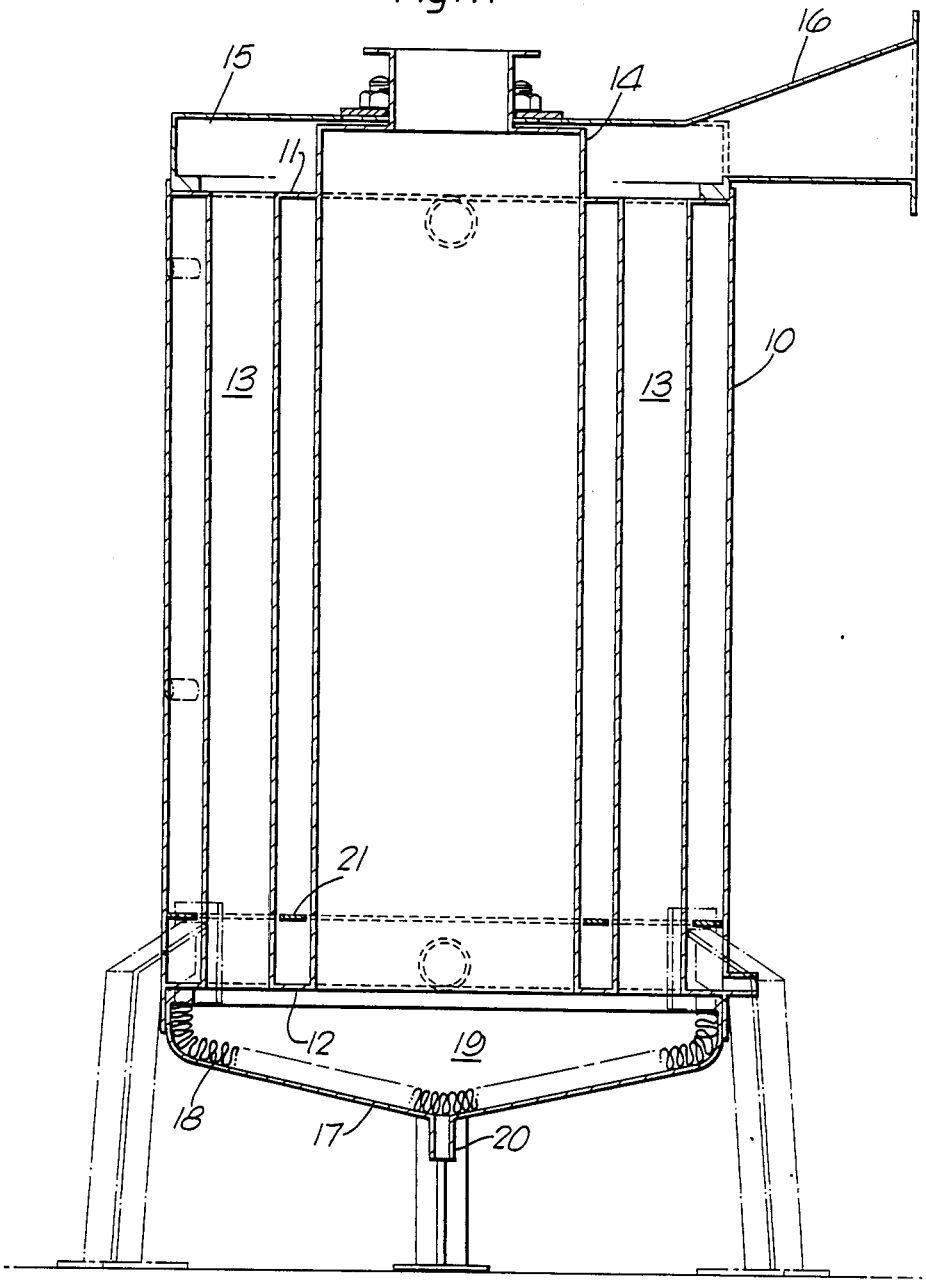
FIG. 1 is a vertical longitudinal section through a first embodiment of a water heater according to the present invention.
Figure 2:
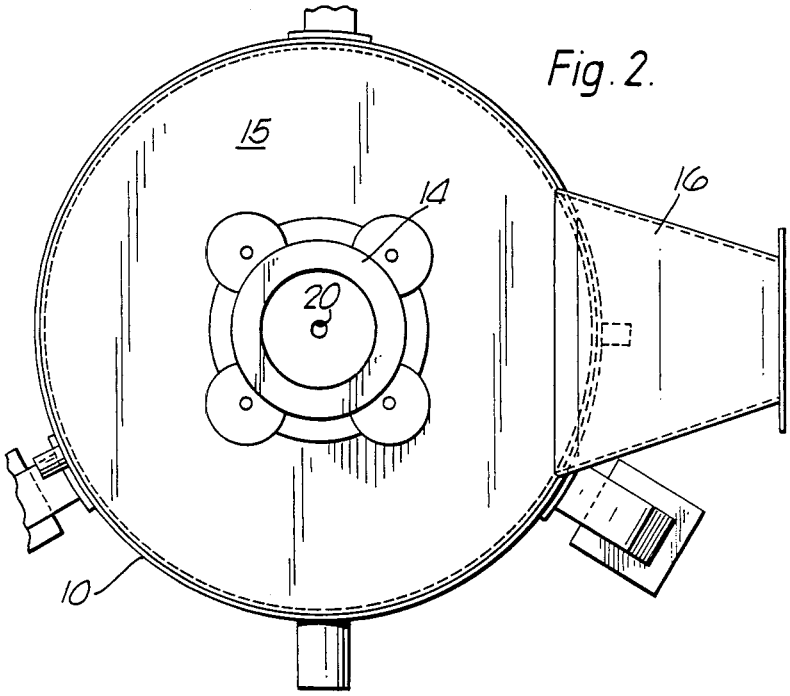
FIG. 2 is a plan view of the water heater of FIG. 1.
Figure 5:
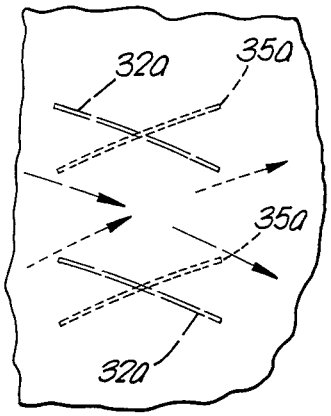
FIG. 5 is a fragmentary side view taken in the direction of the arraw 5 indicated in FIG. 4 showing the vanes in the ducts.
Figure 3:
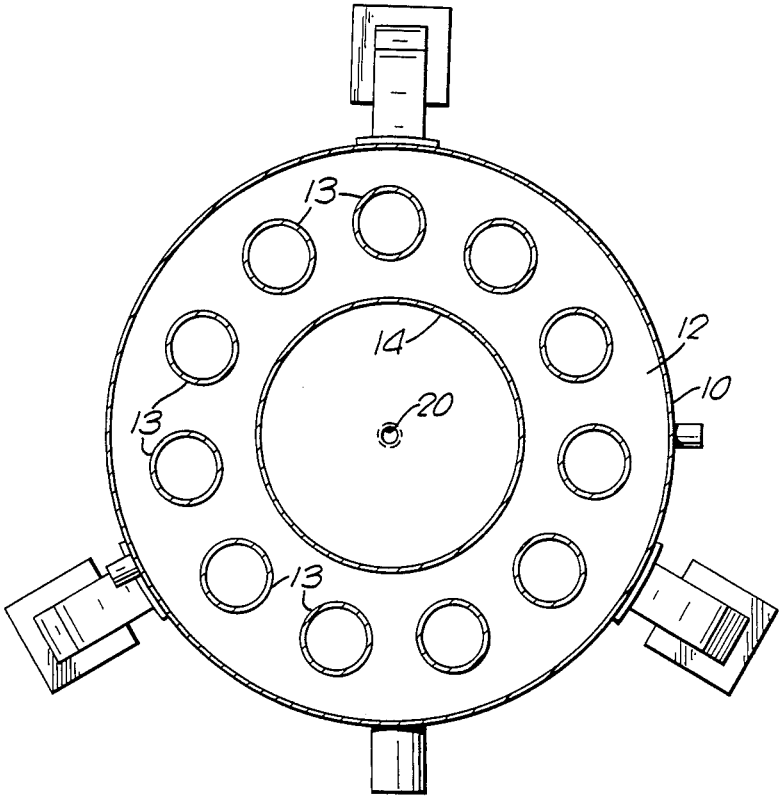
FIG. 3 is a transverse section through the water of FIG. 1.

The water heater shown in FIGS. 1 to 3 comprises a water tank 10 having an upper end wall 11 and a lower end wall 12 and a plurality of vertical tubes 13 which extend through the end walls 11 and 12. Also extending vertically through the end walls 11 and 12 is a central vertical combustion tube 14. The tank 10 is circular and the vertical combustion tube 14 is disposed on the vertical axis of the tank. The tubes 13 are disposed in a circular array around the combustion tube 14. A header chamber 15 is provided at the upper end of the tank 10 and through which the central combustion tube 14 extends. The header chamber 15 is connected to an exhaust duct 16. At its lower end the tank 10 is provided with an end plate 17 which is substantially conical, said end plate 17 being provided with heat insulation 18. The end plate 17 forms a bottom chamber 19 with which all the tubes 13 and the combustion tube 14 communicate. The tubes 13 communicate with the header chamber 15. The apex of the conical end plate 17 is provided with a drain conduit 20 which preferably vents through a water trap formed by an S-bend to retain the pressure within the heater.

At its upper end the central combustion tube 14 is connected to a burner, such as a gas or oil burner having a fan (not shown) for causing the hot combustion gases to flow down the central combustion tube 14. The hot gases enter the chamber 19 and then pass up the tubes 13 to the header chamber 15 where the gases flow through the exhaust duct 16.

In passing through the chamber 19 the gases heat the end plate 17 and if the water heater is operated at a low temperature setting which produces condensation in the tubes 13 and 14 any condensate which falls on to the plate 17 is evaporated or if the plate 17 is too cool to effect evaporation the condensate flows to drain through the drain conduit 20.

When operating at low temperature settings any condensate can not reach the burner and therefore can not extinguish the burner. Thus the water heater can be operated at any desired temperature within a large temperature range.

Such a water heater may be used for heating sea water which is pumped into divers suits to heat them.

The tank 10 is provided with a transverse plate 21 which prevents scale falling onto the lower wall 12. Such a plate 21 constitutes an essential feature of the water heater as claimed in GB-A-2 145 803.

Figure 4:
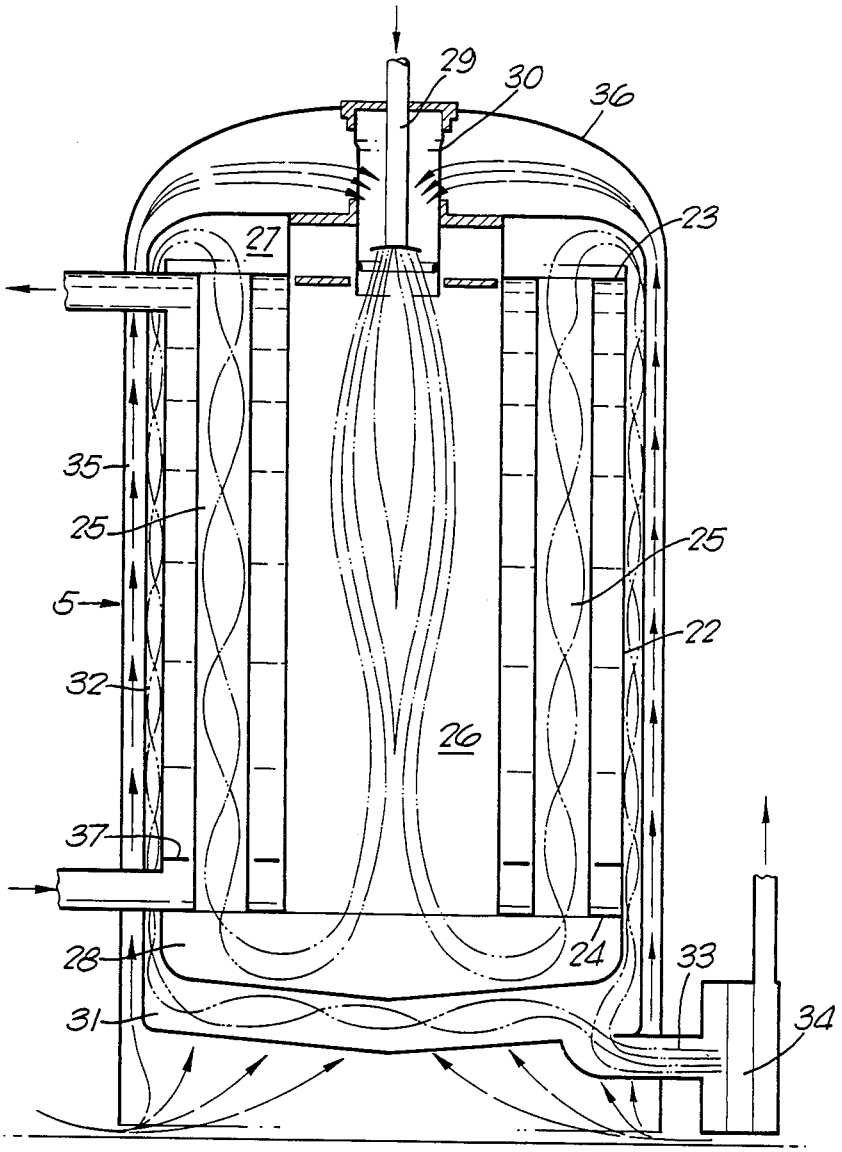
FIG. 4 is a vertical longitudinal section through a second embodiment of a water heater according to the present invention.

The water heater shown in FIG. 4 comprises a water tank 22 having an upper end wall 23 and a lower end wall 24 and a plurality of vertical tubes 25 which extend through the ends walls 23 and 24. Also extending vertically through the end walls 23 and 24 is a central vertical combustion tube 26. The tank 22 is circular and the vertical combustion tube 26 is located on the axis of the tank 22. The tubes 25 are disposed in a circular array around the combustion tube 26.

A header chamber 27 is provided at the upper end of the tank 22 and through which the combustion tube 26 extends. At the bottom of the tank 22 is provided a chamber 28. The tubes 25 communicate with the header chamber 27 and the tubes 25 and the combustion tube 26 all communicate with the chamber 28.

At its upper end the central combustion tube 26 is provided with a gas or oil burner 29 located within a short perforated tube 30 connected to the combustion tube 26.

Located beneath the chamber 28 is a chamber 31 which is in communication with the header chamber 27 via an annular duct 32 surrounding the tank 22. Located in the duct 32 are a plurality of vanes 32*a* which are attached to the radially inner wall of the duct 32 and which cause the exhaust gases to swirl around the duct 32 as the gases flow downwardly through the duct 32 and the vanes 32*a* convey heat to the inner wall of the duct 32. The chamber 31 is provided with an exhaust duct 33 connected to a fan 34 which is preferably driven by an electric motor. The fan 34 can be located at the downstream end of an exhaust duct 33 and thus located at a position remote from the water heater. The exhaust duct 33 may be of small diameter compared with conventional water heaters which require a large flue with negative flue draught. Thus, the fan 34 can be located at either end of the exhaust duct 33.

Surrounding the tank 22 is a further annular duct 35 for conveying air from beneath the bottom of the tank 22 to an air chamber 36 located above the tank 22 and through which the perforated tube 30 extends, the air flowing from the chamber 36 through the perforations in the tube 30 to the to the burner 29. Located in the duct 35 are a plurality of vanes 35*a* which are attached to the radially inner wall of the duct 35 and which cause the air to swirl around the duct 35 as it flows upwardly through the duct 35 and the vanes transfer heat to the air from the inner wall. As seen in FIG. 4, the radially outer wall of duct 35 may be viewed as an outer jacket surrounding the water tank.

The fan 34 draws air through the duct 35 and chamber 36 and draws the combustion gases from the header chamber 27 through the duct 32, chamber 31 and exhaust duct 33 and discharges the exhaust gases to atmosphere.

The tank 22 is provided with a transverse plate 37 which prevents scale falling onto the lower wall 24.

When the water heater is operating at low temperature settings which produces condensation in the tubes 25 and 26 any condensate which falls onto the bottom of the chamber 28 is evaporated or if the bottom of the chamber 28 is too cool to effect evaporation, the condensate is drawn out by the fan 34. When operating at lower temperature settings any condensate can not reach the burner 29 and therefore can not extinguish the burner.

It will be appreciated that many modifications and changes can be made without departing from the scope of the invention as defined in the accompanying claims.

I, therefore particularly point out and distinctly claim as my invention:

1. A vertical tube water heater comprising a water tank and an outer jacket surrounding said water tank, a plurality of vertical tubes located within the tank, one end of each of the tubes being in communication with a first chamber located at the bottom of the tank for receiving hot gases from a burner and the other end of each of said tubes being in communication with a second chamber located at the upper end of the tank, a vertical combustion tube located within the tank, said vertical combustion tube at its upper end being provided with the burner and at its bottom end being in communication with said first chamber, said second chamber being in communication with an exhaust duct via a third chamber located beneath said first chamber, and said exhaust duct being provided with a fan for drawing combustion air through the water heater to the burner and for drawing exhaust gases from the second and third chambers.

2. A vertical tube water heater as claimed in claim 1, in which the vertical combustion tube extends within the second chamber.

3. A vertical tube water heater as claimed in claim 1, in which said tank is circular and the vertical combustion tube is located on the axis of said tank, said plurality of tubes being disposed in a circular array around the vertical combustion tube.

4. A vertical tube water heater as claimed in claim 1, in which the second chamber is in communication with said third chamber via an annular duct surrounding the tank.

5. A vertical tube water heater as claimed in claim 1, in which the burner is located within a perforated tube connected to the upper end of the burner tube and extending through said air chamber.

6. A vertical tube water heater as claimed in claim 1, in which an annular air duct surrounds the tank for conveying said combustion air from beneath the bottom of the tank to an air chamber located above the tank, said air chamber being in communication with said burner.

7. A vertical tube water heater as claimed in claim 6, in which the second chamber is in communication with said third chamber via an annular duct surrounding the tank, and in which the annular duct and the annular air duct are each provided with vanes, which extend within the respective duct.

8. A vertical tube water heater comprising a water tank and an outer jacket surrounding said water tank a plurality of vertical tubes located within the tank, one end of each of the tubes being in communication with a first chamber located at the bottom of the tank for receiving hot gases from a burner and the other end of each of said tubes being in communication with a second chamber located at the upper end of the tank, a vertical combustion tube located within the tank, said vertical combustion tube at its upper end being provided with the burner and at its bottom end being in communication with said first chamber, and said second chamber being in communication with an exhaust duct via a third chamber located beneath said first chamber, whereby said exhaust duct may be provided with a fan for drawing combustion air through the water heater to the burner and for drawing exhaust gases from the second and third chambers.

9. A vertical tube water heater as claimed in claim 8, in which the second chamber is in communication with said third chamber via an annular duct surrounding the tank.

10. A vertical tube water heater as claimed in claim 8, in which the burner is located within a perforated tube connected to the upper end of the burner tube and extending through said air chamber.

11. A vertical tube water heater as claimed in claim 8, in which an annular air duct surrounds the tank for conveying said combustion air from beneath the bottom of the tank to an air chamber located above the tank, said air chamber being in communication with said burner.

12. A vertical tube water heater as claimed in claim 11, in which the annular duct and the annular air duct are each provided with vanes, which extend within the respective duct.

* * * * *

UNITED STATES PATENT AND TRADEMARK OFFICE

CERTIFICATE OF CORRECTION

PATENT NO. : 4,846,150

DATED : July 11, 1989

INVENTOR(S) : Maurice E. G. Maton

It is certified that error appears in the above-identified patent and that said Letters Patent is hereby corrected as shown below:

In column 4, line 13, (claim 1), and in (claim 8)at line 16, after "heater" insert --interiorly of said outer jacket--.

In column 4, line 2, (claim 8), after "tank" insert a comma.

Signed and Sealed this

Twenty-sixth Day of January, 1993

*Attest:*

STEPHEN G. KUNIN

*Attesting Officer*

*Acting Commissioner of Patents and Trademarks*